United States Patent [19]

Roberson

[11] Patent Number: 4,698,241

[45] Date of Patent: Oct. 6, 1987

[54] AUTOMATIC DUAL ACTION APPARATUS AND METHOD FOR UNIFORMLY COATING THE INSIDE OF TUBULAR EXTENSIONS

[76] Inventor: Dalton Roberson, 27 Hollywood Dr., Lampasas, Tex. 76550

[21] Appl. No.: 777,772

[22] Filed: Sep. 19, 1985

[51] Int. Cl.[4] ..... B05D 1/12; B05D 7/22

[52] U.S. Cl. ..... 427/183; 118/308; 118/310; 118/318; 427/233; 427/234

[58] Field of Search ..... 427/181, 182, 183, 231, 427/233, 234; 118/310, 308, 318

[56] References Cited

U.S. PATENT DOCUMENTS

| | | | |
|---|---|---|---|
| 3,207,618 | 9/1965 | DeHart | 427/182 |
| 3,410,250 | 11/1968 | Kulie et al. | 118/308 |
| 3,729,333 | 4/1973 | Imai et al. | 118/318 |
| 3,982,050 | 9/1976 | Kato | 118/318 X |
| 4,089,998 | 5/1978 | Gibson | 118/318 |
| 4,243,699 | 1/1981 | Gibson | 427/181 X |
| 4,420,508 | 12/1983 | Gibson | 118/308 X |
| 4,454,173 | 6/1984 | Koga | 427/235 |

*Primary Examiner*—Shrive P. Beck

*Attorney, Agent, or Firm*—J. Nevin Shaffer, Jr.

[57] ABSTRACT

An automatic dual action apparatus and method for uniformly applying a coating material to the insides of tubular extensions. The apparatus is designed to handle a plurality of pipes of various lengths and inside diameters. The device provides for a unique left to right and, then, right to left application of coating material and a unique interior applicating device that prevents the non-uniform buildup of too much coating material at the beginning of the tubular extensions and not enough at the end of the tubular extensions. The apparatus is capable of being pressurized giving the apparatus the ability to slow the movement of coating material through the tubular extensions as well as to break bubbles of the material that may form on the inside of the tubular extensions being coated and to force the coating material around any pits or weld splatter that may be within the tubular extensions.

11 Claims, 7 Drawing Figures

AUTOMATIC DUAL ACTION APPARATUS AND METHOD FOR UNIFORMLY COATING THE INSIDE OF TUBULAR EXTENSIONS

BACKGROUND OF THE INVENTION

This invention relates to an improved apparatus and method for uniformly coating the insides of tubular extensions.

Coating the inside of tubular extensions such as oilfield tubings has been disclosed and known in the art for quite some time. Coating with a thermal type material applied to a tubular extension which has previously been heated is used to prevent corrosion and erosion. Additionally, drill pipe is customarily coated in order to reduce friction and wear in the pipe. Pipes which have been coated require less pressure to pump fluid due to reduced friction. An example of an interior pipe coating apparatus is disclosed in Warren et al U.S. Pat. No. 4,382,421 which utilizes measured charges of fusible particles for coating the interior of pipes. Another example of a method of powder coating the inside of tubular extensions is shown in Gibson U.S. Pat. No. 4,243,699 which causes an excessive amount of material to be blown through a previously heated pipe. Various factors are combining to make these previous devices totally or partially ineffective and deficient as pipe coaters. Currently, pipe lengths are increasing. The incentive for longer pipe lengths is due to the high cost of ensuring quality joining of pipe sections. Because joints are expensive, pipe lengths have increased. The increased pipe lengths have limited the usefulness of previous inventions in this area due to the fact that these previous devices are unable to provide a uniform interior coating over an extended length. Previous devices have relied on introducing an excessive amount of coating material in order to ensure that all of the interior of the tubular extensions are coated. This procedure results in application of material to the interior of tubular extensions which is too thick at the beginning of the pipe and too thin at the opposite end.

Additionally, it is not infrequent to encounter weld splatter inside tubular extensions which are manufactured with welded seams. Some of this splatter is not removed when the pipe is cleaned prior to applying the coating. In fact, some of the splatter becomes part of the interior of the pipe. Previous methods and apparatus for applying coatings to the insides of tubular extensions are incapable of ensuring that the hills, bumps and cavities caused by weld splatter will be sufficiently covered to produce and acceptable coating.

Further, because the coating material utilized to coat the interior of these tubular extensions is expensive, and because previous systems utilize an over sufficiency of the material to ensure that the entire length of the pipe is coated, a certain portion of the material passes through the heated pipe and comes out the opposite end unattached. In prior apparatus, this material then is aded to the new material for reuse in the coating of pipes. The problem with this procedure is that the coating material which has once passed through and been heated by a pipe, even though it does not adhere to the insides of the pipe, cannot help but be affected by the heat because it is designed to be thermal sensitive. As a result, the partially heated material which has adhered, in most instances, to other particles but not to the pipe is not of a uniform size when it is mixed with the new, unused coating material. This contamination of new material with used, partially heated material adds to the problem of non-uniform coating of the interior of the tubular extensions.

A further drawback of previous devices is that they rely on the quick response of a human operator at the far end of a tubular extension to collect the excess material which is blown through the pipes. Inevitably, some of this material is blown onto the operator and into the atmosphere where it can be inhaled, thereby presenting a serious health hazard. Still another drawback of previous devices is that they were unable to ensure constant rotation speeds for variously sized pipes. These previous devices work reasonably well when the same diameter pipe is coated in many consecutive sections. But, with previous systems, each different sized diameter pipe rotates at a different speed thereby causing delay for altering speed or non-uniform rotation and application speeds if no change is made. Yet another drawback in previous devices is that no means is provided for the preparation of the bitter ends of the tubular extensions. That is, once the pipe interior is coated, it is also necessary to coat the very ends of the pipe. In previous devices this is done by hand when the pipe is rotating at very high speeds. This activity requires operators to approach a dangerously rotating pipe section for application of coating material.

Thus, there is a need in the art for providing a coating device which turns all pipe sections, no matter what their length or diameter, at a constant, predetermined speed, that does not utilize an excess amount of coating material nor introduce excess coating material into the atmosphere thereby causing a health hazard, that does not reutilize heat sensitive material which has been exposed to heat and contaminated, which avoids the problem of heavy buildup of coating material at one end and light buildup of material on the opposite end of the pipe and which provides for safe rotation of the pipe during end preparation. It, therefore, is an object of this invention to provide an improved apparatus and method for uniformly applying a coating to the interior of cleaned and heated tubular extensions.

SHORT STATEMENT OF THE INVENTION

Accordingly, the improved system and apparatus for an automatic dual action device for uniformly coating the inside of tubular extensions includes a pair of oppositely positioned rotatable support cones for supporting and rotating a plurality of variously sized, length and diameter, pipes. A pair of moveable motors are attached to these rotatable cones so that the cones can in fact be rotated. Two oppositely positioned fluid beds for the containment of a coating material are provided and are connected by a stationary transfer means to the rotatable cones. A gas delivery system which utilizes gas, such as air, is provided which enables the operator to introduce or withdraw air from the stationary transfer means. The device also has a measuring system that determines the length of the tubular extension supported between the two rotatable cones. This information, along with the size of the inside diameter of the particular pipe, enables the operator to determine the amount of coating material which is needed to exactly coat the pipe as described hereafter. The device is also provided with a radially finned directing means which is located in each of the rotatable support cones. The radially finned directing means has a hollow tube in the center which directs the majority of the coating material into the pipe some distance past the entrance of the pipe. A relatively smaller portion of the coating material is directed to radial fins which turn around the center hollow tubes in a direction opposite to the direction of rotation of the pipe. As a result, this smaller portion of the coating material is traveling more slowly when it enters the pipe and balloons into the pipe at its very beginning. This prevents the heavy buildup of coating material at the beginning of pipes so prevalent in other devices.

A governing system is also provided whereby the operation of both sides of the device are controlled and coordinated. Through use of the governing system, according to the length and inside diameter of the section to be coated, one side of the device will be activated and an amount of coating material which will almost reach, but not exceed, the opposite end of the pipe is admitted into the system. As soon as this coating material has been introduced to and has adhered to the inside of the pipe, the opposite side of the system is energized and an amount of coating material sufficient to almost reach, but not exceed, the opposite end of the pipe is introduced. As a result, an overlapping effect is created similar to that of normal strokes of a paintbrush so that total, uniform coating of the inside of a pipe is provided while undue buildup of material at the entrances of the pipe is avoided and non-uniform hills, bumps and cavities are coated.

BRIEF DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE PREFERRED EMBODIMENT

Figure 1:
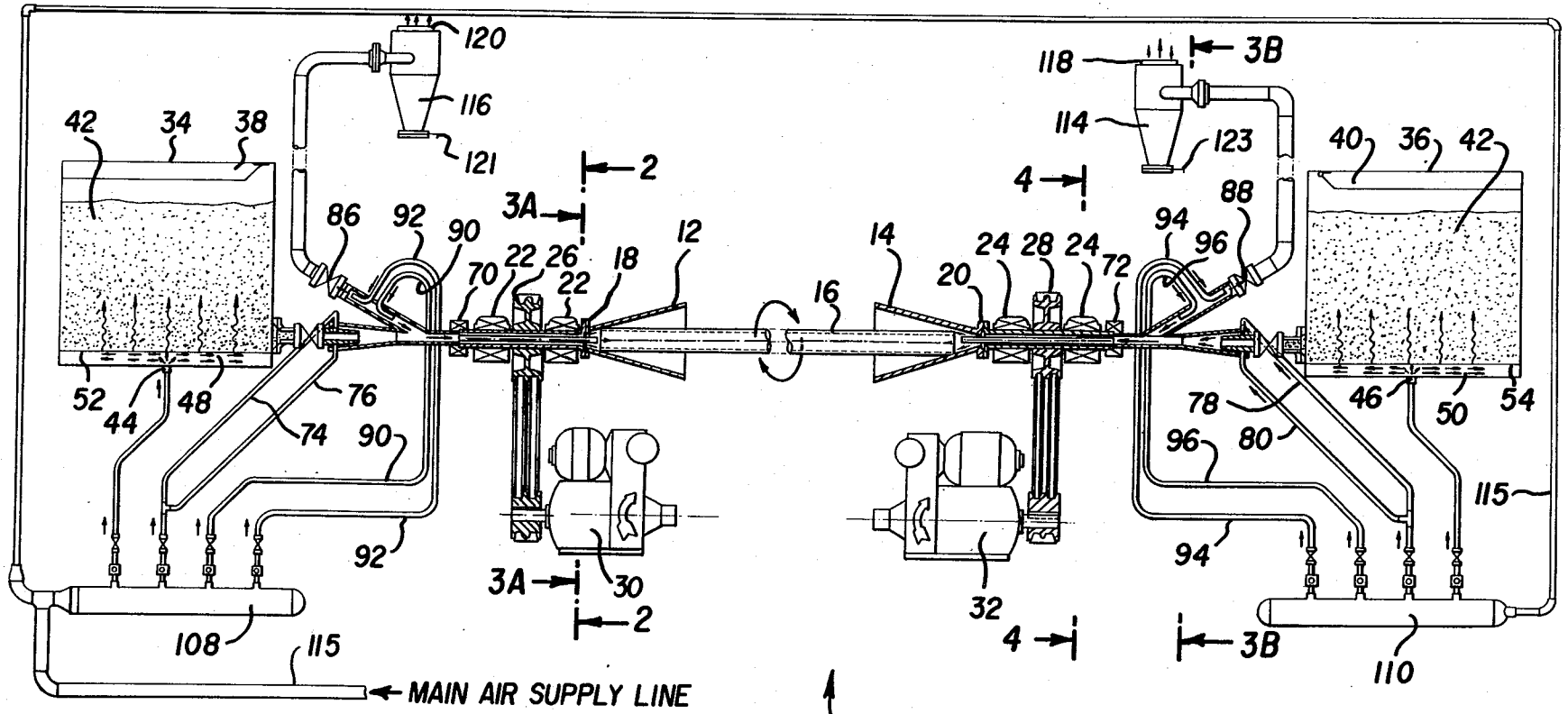
FIG. 1 is an overall schematical representation of the process and equipment according to the present invention.

The preferred embodiment of the present invention is illustrated by way of example in FIGS. 1-7. With specific reference to FIGS. 1-4, device 10 is illustrated with two oppositely positioned rotatable cones 12 and 14. The wide ends of cones 12 and 14 face outward in order to receive pipe 16. It can be seen from the illustration in FIGS. 1 and 3 that the inside diameter of pipe 16 can be of a plurality of sizes and still be contained by rotatable cones 12 and 14. The narrow ends of rotatable cones 12 and 14 are securedly joined to rotating sections 18 and 20, respectively. Each of the rotatable cones 12 and 14 is supported by two pillow block bearings 22 and 24, respectively. Pillow block bearings 22 and 24 are of conventional design and are not disclosed herein in detail since such bearings are available commercially and are well known to those of ordinary skill in the art. Two oppositely positioned belt and pulley systems 26 and 28 are securedly engaged with sections 18 and 20 of rotatable cones 12 and 14. Belt and pulley systems 26 and 28 are located between the pairs of pillow block bearings 22 and 24 and are engagedly connected to moveable motors 30 and 32, respectively. The motors 30 and 32 are not disclosed herein in detail since motors such as these are available commercially and are well known to those of ordinary skill in the art. Both motors 30 and 32 operate in conjunction with belt and pulley system 26 and 28 to rotate rotatable cones 12 and 14 in the same direction. As a result of this configuration, no matter what the size of pipe 16, it will be rotated at a constant speed without necessity of changing pulleys or motors. Additionally, motors 30 and 32 are mounted on a track guidance system, more fully described in FIG. 4 hereafter, which enables motors 30 and 32 to move laterally so as to admit pipes of various lengths into rotatable cones 12 and 14. A measuring system, of ordinary design, determines the length of each pipe to be coated by reference to the location of the motors 30 and 32. This information is utilized by a programmable controller, more fully described hereafter, to determine how much coating material is to be admitted to properly coat a piece of pipe.

Figure 2:
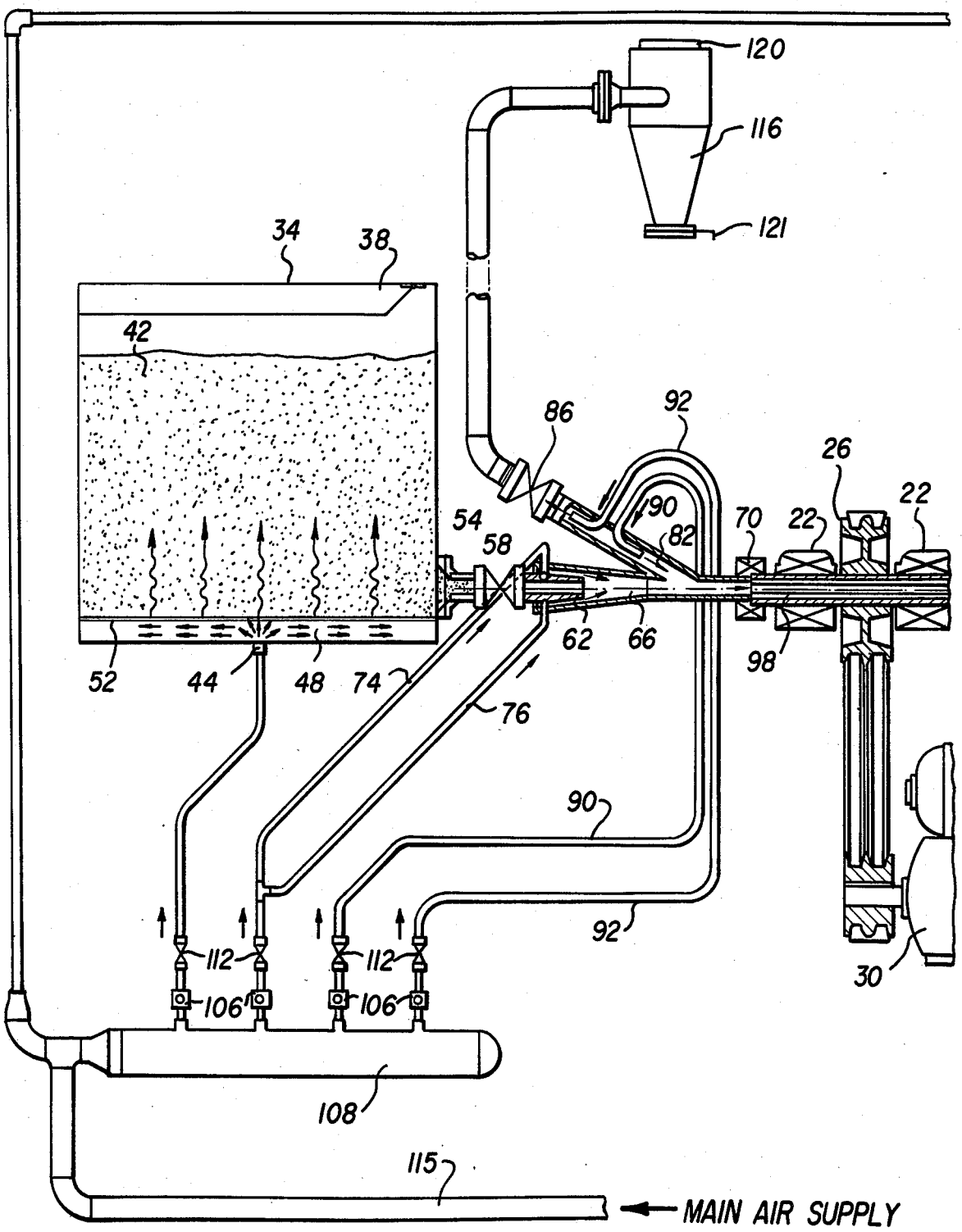
FIG. 2 is an enlarged sectional view of the left side of the device in FIG. 1 taken along line 2—2.
Figure 3:
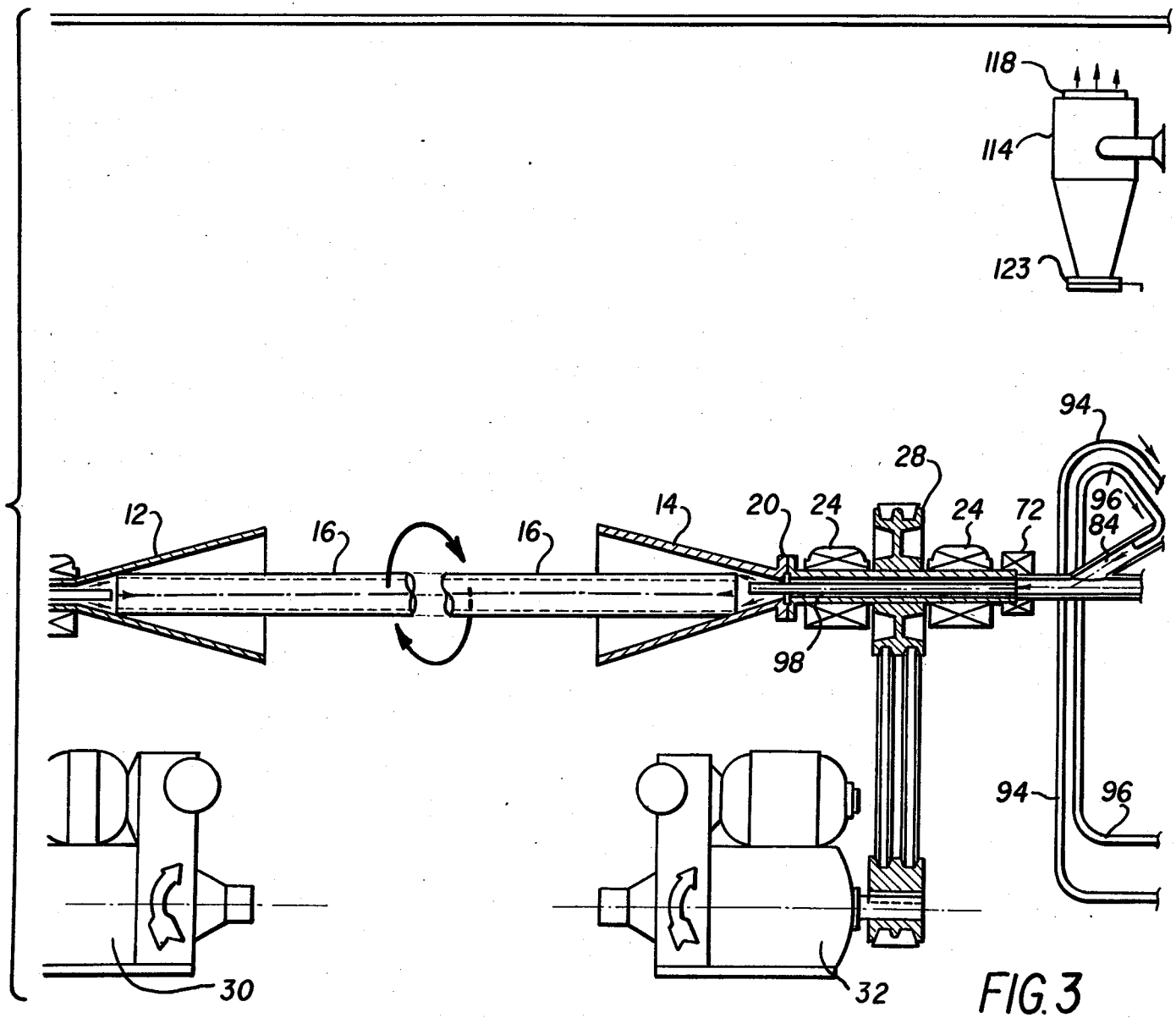
FIG. 3 is an enlarged sectional view of the middle of the device in FIG. 1 taken between lines 3A and 3B.
Figure 4:
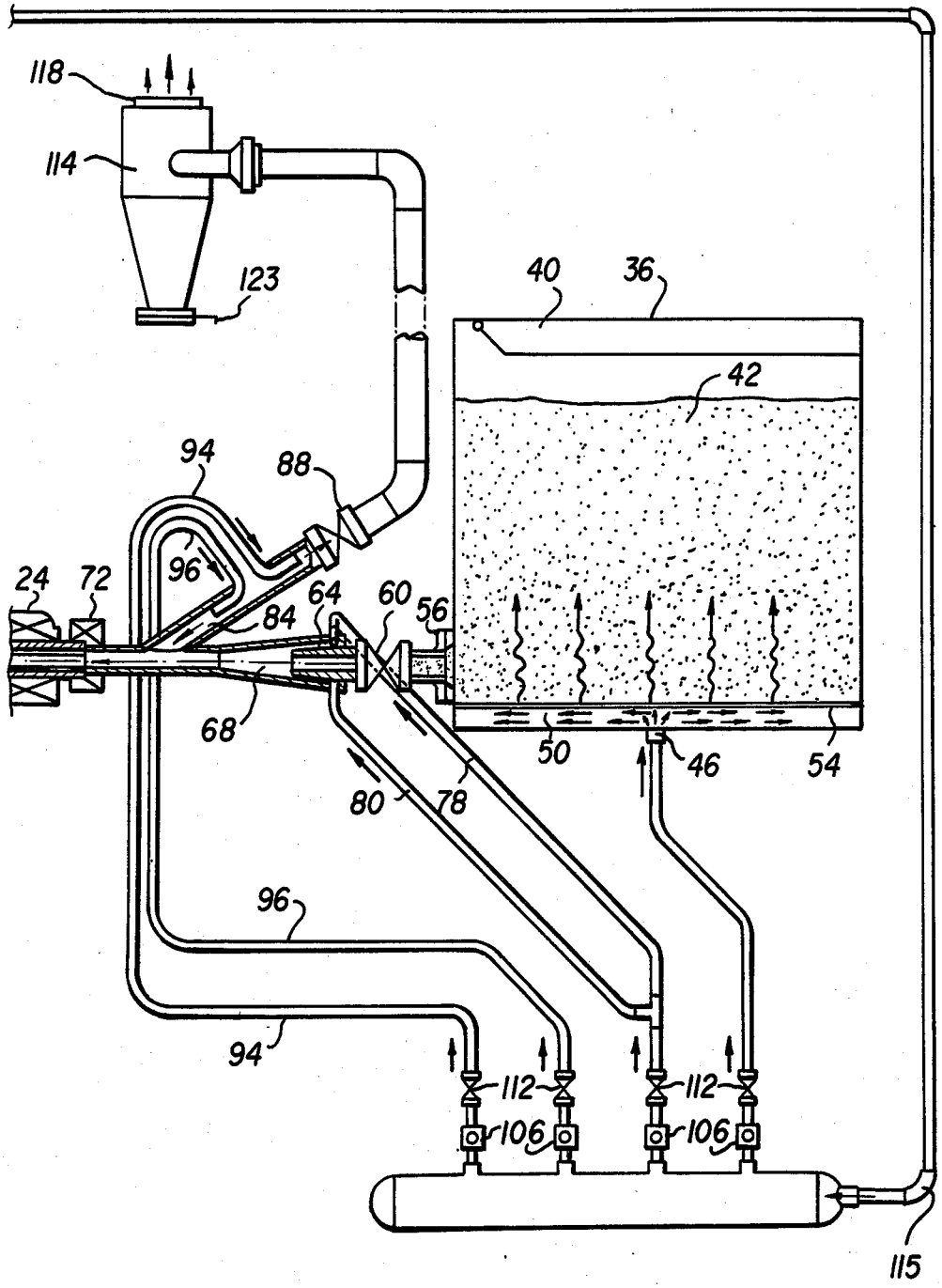
FIG. 4 is an enlarged sectional view of the right side of the device in FIG. 1 taken along line 4—4.

Also illustrated in FIGS. 1, 2 and 4 are fluid beds 34 and 36. These fluid beds 34 and 36 have a hinged top 38 and 40 which open to admit coating material 42. Connections 44 and 46 in the base of fluid beds 34 and 36 allow gas to be introduced into gas receiving chambers 48 and 50. Gas permeable membranes 52 and 54 keep coating material 42 out of gas receiving chambers 48 and 50 while allowing gas to enter the fluid beds 34 and 36. As a result of the introduction of gas, such as air, into fluid beds 34 and 36, coating material 42 is aerated and behaves much as a fluid. An exit port, 54 and 56, is located low on the side of the fluid beds 34 and 36 just above the permeable membranes 52 and 54. Attached to exit ports 54 and 56 are quick operating valves 58 and 60.

Figure 5:
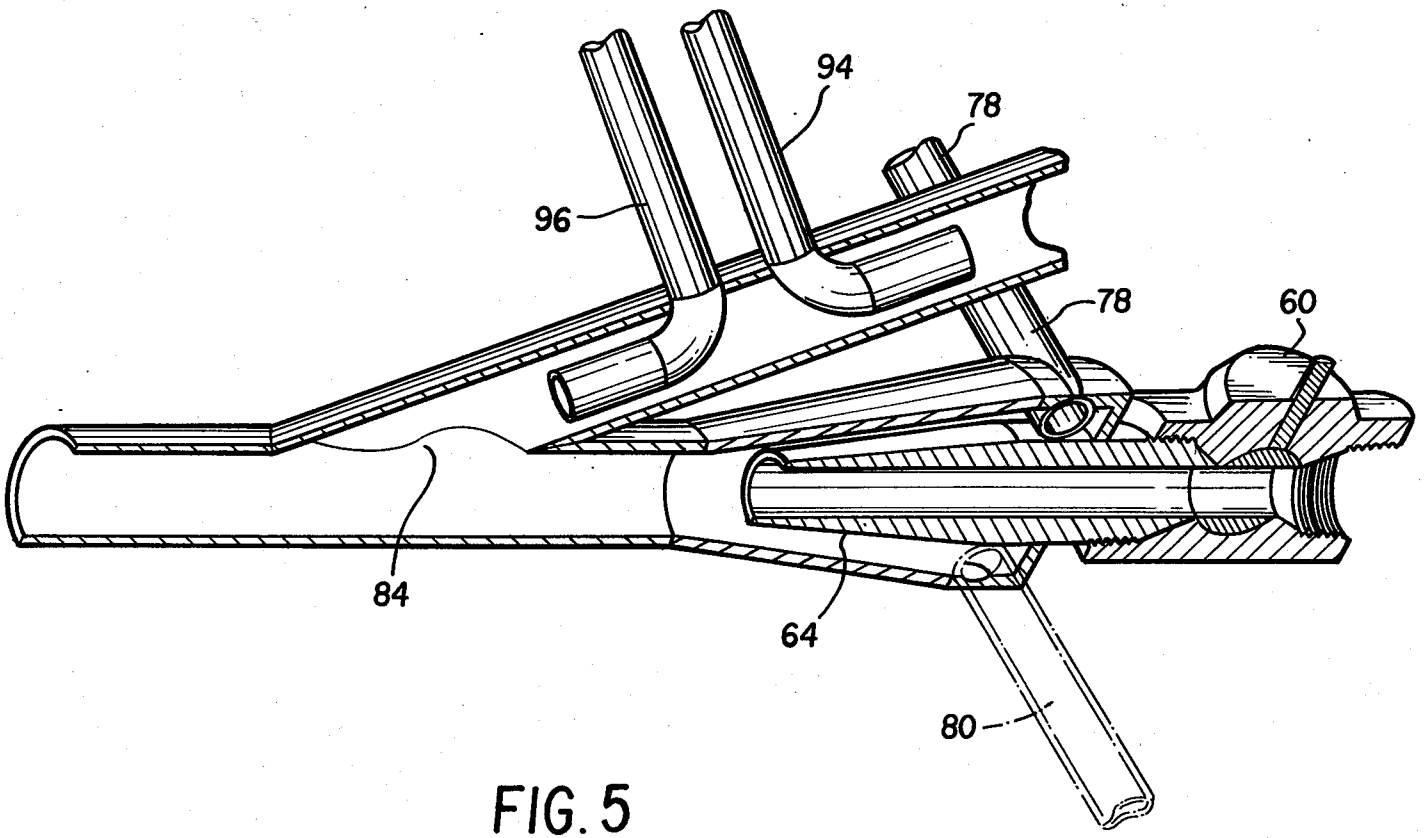
FIG. 5 is a sectional view of the gas chamber wherein gas may be introduced to or withdrawn from the mixing chamber.

As illustrated in FIG. 5, attached to the other end of quick operating valves 58 and 60 are tapered nozzles 62 and 64. A stationary coating materiall and gas mixing chamber 66 and 68 is securedly attached to taper 62 and 64 so that taper 62 and 64 extend into the coating material and gas mixing chambers 66 and 68. The opposite ends of gas mixing chambers 66 and 68 are connected to the rotatable cone sectons 18 and 20 by means of a rotatable pressure sealing bearing 70 and 72. Two oppositely positioned gas introduction means 74 & 76 and 78 & 80 are securedly attached to and projected into the gas mixing chambers 66 and 68 just after where these mixing chambers attach to tapers 62 and 64. Gas introduction means 74 & 76 and 78 & 80 are positioned so as to cause gas introduced into the mixing chambers 66 and 68 to rotate and swirl within these chambers.

Refering to FIGS. 1-5, it is shown that attached to gas mixing chambers 66 and 68 are gas chambers 82 and 84 which open into gas mixing chambers 66 and 68 at a point in these mixing chambers between tapers 62 and 64 and rotatable pressure sealing bearings 70 and 72. The other end of gas chambers 82 and 84 is attached to quick operating valves 86 and 88, respectively. Two gas introduction means 90 & 92 and 94 & 96 are securedly attached to and project into gas chamber 82 and 84, respectively. Gas introduction means 90 & 92 and 94 &

96 are so positioned that gas introduction means 92 and 94 direct gas to quick operating valves 86 and 88, respectively, and gas introduction means 90 and 96 direct gas to gas mixing chambers 66 and 68, respectively. As a result of this configuration, gas, such as air, may be introduced to or withdrawn from said gas mixing chambers 66 and 68. Additionally, with pipe 16 in place, a suction may be drawn on and through the pipe 16 from either end of pipe 16, pressure may be allowed to build in pipe 16, or air may be blown through pipe 16 from either direction depending on which configuration and which gas introduction means is operated.

Figure 6:
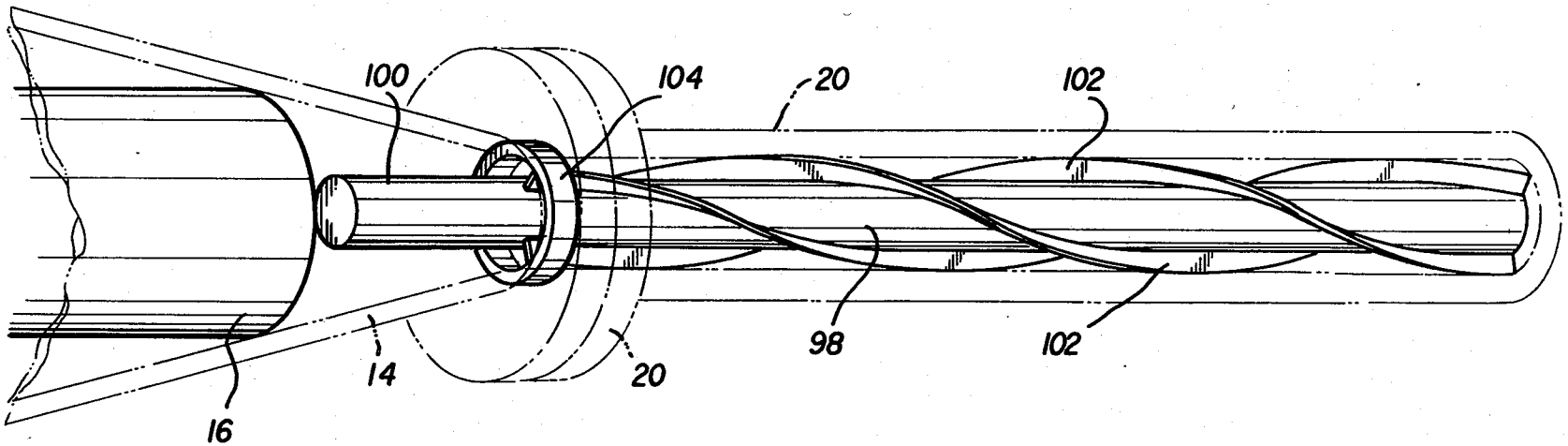
FIG. 6 is a sectional view of the radially finned directing means.

Referring to FIG. 6, radially finned directing tube 98 is illustrated as securedly attached to rotatable cone section 20. (Rotatable cone section 18 is shown in shadow form in FIG. 6.) Radially finned directing tubes 98 are composed of an inner directing tube 100 which receives relatively more of coating material 42 and directs the coating material 42 in a concentrated stream past the opening of pipe 16 and into the center of pipe 16. A series of outer directing vanes 102 are securedly attached to the outer surface of inner directing tube 100 in a spiral manner which is opposite from the direction in which the radially finned directing tube 98 will rotate. As a result of this configuration, relatively less of coating material 42 will travel along the outer directing vanes 102 in a direction opposite from the direction of rotation of radially finned directing tube 98. As a result, coating material 42 which travels in this manner will be forced outward and expand outwardly immediately after exiting the radially finned directing tube 98. This will cause the beginning portion of pipe 16 to be properly, but not overly, coated with coating material 42. Radially finned directing tubes 98 also include a pair of oppositely positioned vane retention and support rings 104 which wrap around and are attached to directing vanes 102 at each end of the vanes.

The operation of device 10 is governed by use of a series of air regulation means 106 attached to air manifolds 108 and 110 on one end and to electrically operated quick opening valves 112 on the other. By means of this arrangement, a predetermined and adjustable amount of gas, such as air at regulated pressures, may be introduced into the system in accordance with the desired operation of quick operating valves 112 which are governed by a programmable controller discussed more fully hereafter. Manifolds 108 and 110 are connected in series to a main dry air supply of conventional design (not shown) by means of main air supply line 115. Quick operating valves 112 are connected to air connection means 44 and the base of fluid container 34 and 36, to gas introduction means and 74 & 76 and 78 & 80, as well as gas introduction means 90 & 92 and 94 & 96. Device 10 is governed by a programmable controller which receives information concerning the length of the pipe to be coated as well as the diameter of the pipe and then signals the air regulation devices 106 and the quick operating devices 112 as to how long and in what sequence they should be opened. Additionally, quick operating valve 58 and 60 are governed to open, according to the specific requirements of each pipe, for various lengths of time thereby admitting the appropriate amount of coating material for each pipe section.

To determine coating amounts to be applied, take one square foot of flat metal plate (144 sq. in.) heated to approximately 425 degrees F. or the recommended temperature for the coating material. Take a weighed amount of coating material and apply a portion of it to the heated metal plate to the desired mill thickness. Take the weight of the powder left, and subtract it from the initial amount. This is the amount of powder required to coat one square foot of pipe to a desired thickness. Therefore, by taking the length and inside diameter of a pipe to be coated, the number of square feet of surface can be determined. The weight of coating material required to coat one square foot multiplied by the number of square feet of pipe surface equals the amount of material needed to coat a given length of pipe to a given millage or thickness. With this data a programmable controller can be programmed to execute the function of quick operating valves 112 and air regulation devices 106 for the time necessary to coat one foot of pipe. A simple measuring device of ordinary design compares the relation of moveable motors 30 and 32 and thereby provides the programmable controller with the length of pipe in the coating device. With this data the programmable controller operates the quick operating valves 112 and air regulation devices 106 for the exact amount of time needed to coat the entire length of a given section of pipe to a given thickness.

EXAMPLE

A length of 2" I.D. pipe, 30 feet in length has 5 square feet of surface. As has been previously described, if it takes 8 ounces of coating material to coat one square foot of surface, it will take 2½ pounds of coating material to properly coat this length of pipe.

If quick operating valves 58 and 60 will let a particular type of coating material 42 pass thru at 8 ounces per second with air lines 74-76 and 78-80 operated at 30 pounds of pressure, it will take 5 seconds for 2½ pounds of the coating material to pass thru valves 58 and 60. Since the coating device of this invention operates from both ends, valve 58 and 60 will be open for 2½ seconds each to coat the 30 feet of pipe 16 to the required thickness. This timing information is programmed into the controller before operation begins.

In summary, since different coating materials have different formations, different weights of different materials are required for a given coating thickness. By determining the amount of a particular coating needed for properly coating one square foot, the appropriate amount of material can be determined for a given length of pipe. This information can be stored on a cassette tape and placed in the programmable controller when pipe diameter or coating material change. This eliminates readjustment of the coating machine when pipe diameter or coating material change. To make changes in the timing of the system, the operator simply takes out one tape and replaces it with a tape that has been programmed for the given diameter and coating material. This takes just a few minutes and the system is ready to operate again.

Programmable controllers of the type described are known in the art and, therefore, have not been described herein in detail. An example of a suitable programmable controller is produced by Omron Electronics, Inc. of One East Commerce Drive, Schaumburg, Ill. 60195, 312/843-7900, under the tradename SYSMAC-S6.

Referring again to FIG. 6, also provided are two breather-muffler-filter devices 114 and 116 which are connected to the quick operating valves 86 and 88. When quick operating valves 86 and 88 are opened, the sound of the operation of device 10 is muffled and the exhaust is filtered so that none of the by products of the coating, or the coating material 42 itself, are released into the atmosphere. Filter means 118 and 120 are shown at the top of muffler devices 114 and 116. Filter means 118 and 120 are removable and replaceable after being cleaned. Slide valves 121 and 123 at the bottom of devices 114 and 116 are provided to remove any large foreign particles which may be collected.

Figure 7:
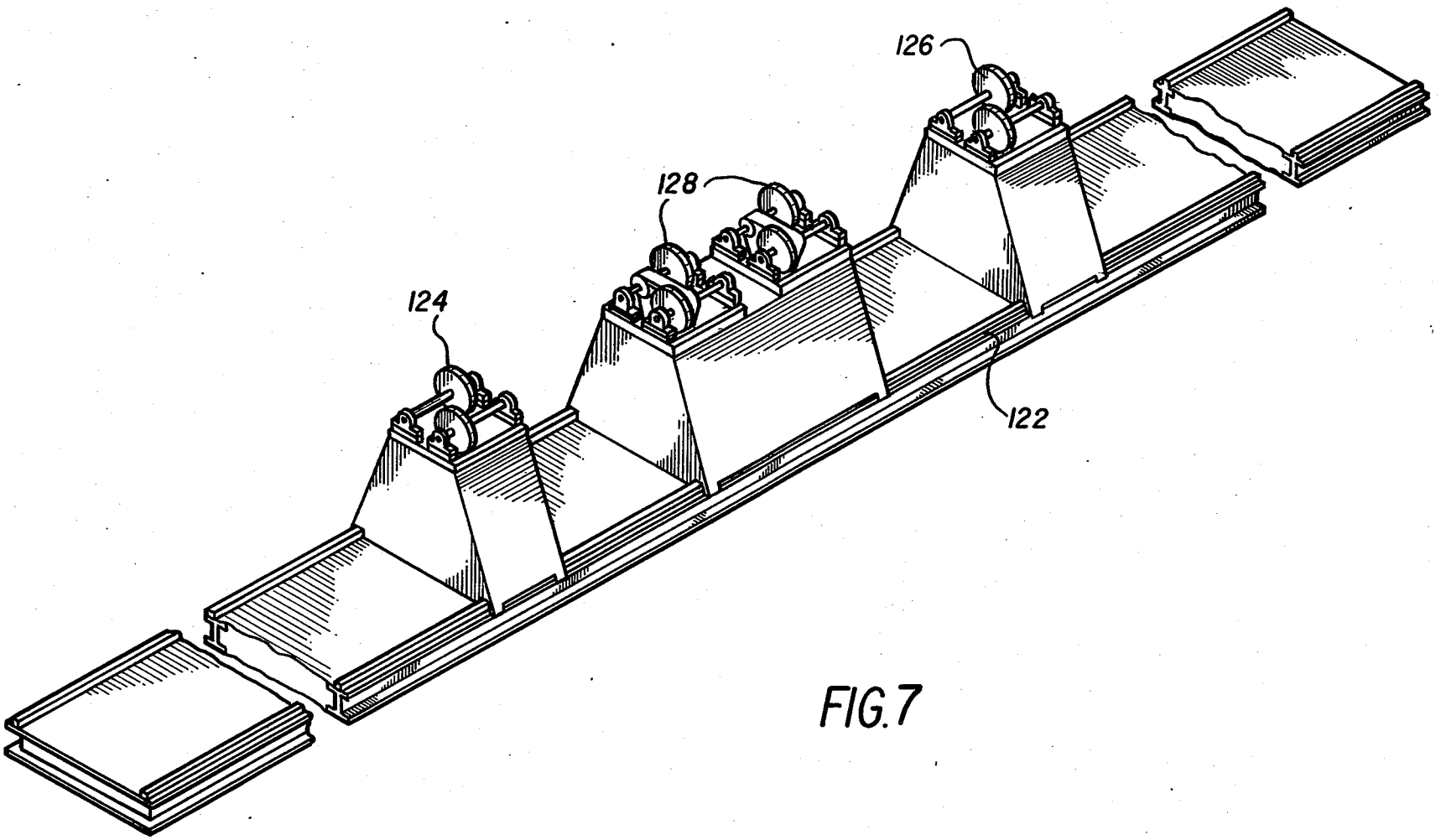
FIG. 7 is a plan view of the idler and powered roller devices on the tract guidance means.

Referring now to FIG. 7, tract guidance means 122 is illustrated. Tract guidance means 122 supports moveable idler devices 124 and 126. Idler devices 124 and 126 support pipe 16 when coating is complete and the pipe is transfered to track guidance means 122 for end preparation. That is, once the interior coating of pipe 16 has been accomplished, moveable motor 32 and rotatable cone 14 back away from pipe 16 as does moveable motor 30 and rotatable cone 12. At this point, pipe 16 is supported by three idlers, not shown, which provide support during and after the coating process and which are of the same design as idlers 124 and 126. After transfer "downstream", idlers 124 and 126, in conjunction with powered roller means 128, support pipe 16. Once pipe 16 is in this position, powered roller means 128 is energized and pipe 16 is rotated, at a reduced speed, in order that final end preparation of pipe 16 may be accomplished by coating the very end sections of pipe 16 with coating material 42. Once this has been accomplished, the coating of pipe 16 is complete.

In operation, device 10 receives gas such as air from a main supply line 114 where it is stored in manifolds 108 and 110. Coating material 42 is located into fluid bins 34 and 36 through hinged tops 38 and 40, respectively. Air is introduced into fluid bins 34 and 36 through air connection means 44 and 46 as regulated by gas regulators 106 and quick operating valves 112. Gas, such as air, passes through connectors 44 and 46 and enters gas receiving areas 48 and 50. From there the gas passes through permeable membrane 52 and 54 and "fluidizes" coating material 42. In preparation for receipt for pipe 16, moveable motors 30 and 32 are retracted along a tract, not shown, similar to tract guidance means 122. Three idler means, not shown, similar to idler means 124 and 126 receive and support the heated pipe 16. Movable motors 30 and 32, along with rotatable cones 12 and 14, are advanced toward each other until pipe 16 is securely held in position by rotatable cones 12 and 14 and the idler devices, (not shown). Pipe 16 is then rotated by rotatable cones 12 and 14 which are turned by means of belt and pulley systems 26 and 28 attached to moveable motors 30 and 32. Because of the cone shape of rotatable cones 12 and 14, pipes of an almost infinite variety of diameters may be accomodated. As a result, no extraordinary measures are needed to handle pipes of various diameters and every pipe is rotated at the desired speed. Pipe 16 is now in position for interior coating.

Assuming the coating process will start from left to right and having taken into consideration the length of the pipe to be coated and the inside diameter of the pipe, the programmable controller signals quick operating valve 88 to open at this time. Gas introduction means 94 is activated so that gas is withdrawn from the system from left to right and expelled to breather muffler filter 116. At the same time, air introduction means 74 and 76 introduce air into gas mixing chamber 62 and cause the air within the chamber to swirl and create a reduced air pressure area at valve 58. Quick operating valve 58 then opens for the predetermined period of time necessary to provide coating material 42 in sufficient quantity to almost reach, but not exceed, the opposite end of pipe 16. Because of the suction caused by air introduction means 74 and 76, coating material 42 is sucked from fluid bin 34 and pulled, not pushed, through pipe 16. The required quantity of coating material 42 passes through taper 62 and gas mixing chamber 66 where it is swirled and then sucked and pulled by gas introduction means 74 and 76 and pulled by gas introduction means 94 into section 18 of rotatable cone 12 and into radially finned directing tube 98. The majority of coating material 42 enters inner-directing tube 100 while a minority of coating material 42 follows the outer directing vanes 102 in a direction counter to the direction of rotation of pipe 16 and the outer coating material 42 is thereby slowed. The coating material 42 in inner-directing tube 100 is then forcibly deposited past the entrance of pipe 16 and into the center of rotating pipe 16 where it adheres to the inside of the pipe as previously disclosed. Coating material 42 which follows outer directing vanes 102 is thrown outwardly as a result of the outer directing vanes 102 and blossoms into the opening of pipe 16 so that the very beginning of pipe 16 receives an even coating. As a result of this operation, a heavy buildup of coating material 42 at the entrance of pipe 16 is prevented in contrast to previous devices. As coating material 42 moves through pipe 16, it picks speed as more and more of the material is deposited on the inside of pipe 16. In order to slow the coating material 42, quick operating valve 88 is now closed and gas introduction means 94 is shut off. Without doing anything further, the continued addition of air through gas introduction means 74 & 76 would build up pressure within the closed system which would act to slow the material down. If additional pressure is desired, gas introduction means 96 may be activated so that air is directed into the system from the opposite end.

At this point, the first stage of the coating process as disclosed by this invention has been completed. Now quick operating valve 86 opens, air introduction means 92 is activated and air is withdrawn from pipe 16 in a right to left direction. Any gas or debris left from coating material 42 which did not adhere to the pipe in the first stage of application will be withdrawn from the system and filtered completely. Gas introduction means 78 and 80 are activated to swirl the air in the mixing chamber 68 and create a reduced air pressure area at valve 60. At this point, quick operating valve 60 is opened in order to allow suction on fluid bed 36 and the coating material 42 therein. Coating material 42 is sucked and pulled through tapered nozzle 64, is swirled in the air from air introduction means 78 and 80, and blown into radially finned directing tube 98. Once again, the majority of coating material 42 passes through inner directing tube 100 and past the entrance to pipe 16 and further into the center of pipe 16. A relative minority of the coating material 42 passes down the outside along the outer directing vanes 102 in a direction opposite to the rotation of the pipe and the radially finned directing tube 98. This causes the material to travel more slowly and to blossom outward at the opening of pipe 16. As a result, heavy buildup of coating material 42 at the beginning of pipe 16 is avoided and a more even application of coating material is achieved. The combination of the left to right coating and the right to left coating completes one full sequence. Total elapsed time for the complete sequence is 15 to 30 seconds.

As previously described, at this point quick operating valve 86 may be closed and gas introduction means 92 stopped. This closes the system and with gas introduction means 78 & 80 continuing to introduce gas into the system, the pressure will begin to build and coating material 42 will be slowed down. Additionally, gas introduction means 90 may be activated to introduce gas from the opposite end to help continue to slow down coating material 42. The unique ability of the system to be pressurized in this manner also adds to and enhances the improved coating ability provided by the back and forth coating apparatus. The enhanced benefit is that the pressure will force the coating material 42 into cracks and crevices created by weld splatter within the pipe 16 or into pits in old pipe. Also, it is not infrequent that bubbles of coating material 42 are formed for various reasons within pipe 16. The ability to pressurize the pipe enables these bubbles to be broken and a uniform and gap free coating applied. At this time all gas introduction is stopped and quick opening valve 88 is opened to release pressure into breather, muffler, filter 116.

Once pipe 16 has been coated, movable motors 30 and 32 and rotatable cones 12 and 14 are backed away from pipe 16. At this point, pipe 16 is supported by idler devices, not shown, similar to idlers 124 and 126. At this time pipe 16 is passed downstream and onto powered roller means 128 and idlers 124 and 126. Powered roller means 128 is energized and the pipe is turned so that final end preparation of the very ends of pipe 16 may be applied by hand. At this point, the pipe has been completely, uniformly and automatically coated with a uniform layer of coating material 42.

While the present invention has been disclosed in connection with the preferred embodiment thereof, it should be understood that there may be other embodiments which fall within the spirit and scope of the invention as defined by the following claims.

What is claimed is:

1. Automatic dual action self contained method for uniformly coating the inside of tubular extensions comprising the steps of:

A. providing a pair of oppositely positioned rotatable cones with the wide end facing outwardly to receive one end of a tubular extension;

B. securedly connecting the narrow end of said rotatable cone, by a connecting means, to a rotating section of uniform circumference within which a radially finned directing means is secured;

C. connecting the opposite end of said rotating section, by means of a rotatable pressure sealing means, with a stationary transfer and mixing means from each of two oppositely positioned fluid beds;

D. engageably attaching two oppositely positioned belt and pulley systems to the rotating sections of two moveable motors;

E. providing two pillow block bearings, one on either side of said belt and pulley systems, for supporting said rotating section whole allowing said rotating section to turn freely;

F. providing a connection in the base of said fluid beds whereby gas, such as air, may be introduced into said fluid beds;

G. creating a gas receiving chamber in said fluid beds formed by the base and side walls of said fluid bed and a gas permeable separator, which prevents coating material contained in said fluid beds from invading said receiving chamber and which allows gas to pass through said permeable separator into said fluid beds containing said coating material;

H. locating an exit port low on a side of said fluid beds so that an exit for said coating material is formed in said fluid bed just above said permeable separator which is in line with and securedly attached to said stationary transfer and mixing means;

I. attaching a secure connection to said exit port;

J. locating a quick operating valve means just after said exit port connection;

K. attaching a tapered nozzle to the opposite end of said quick operating valve;

L. secureably attaching a coating material and gas mixing chamber to said tapered nozzle near the base of said tapered nozzle so that said tapered nozzle extends into said mixing chamber and wherein said mixing chamber is connected to said rotatable support cone by means of said rotatable pressure sealing means;

M. secureably attaching two oppositely positioned gas introduction means to said gas mixing chamber near the base of said gas mixing chamber where said gas mixing chamber attaches to said tapered nozzle wherein said gas introduction means are positioned so as to cause gas introduction into said gas mixing chamber to rotate and swirl within said mixing chamber and to create a reduced air pressure at said quick operating valve means;

N. secureably attaching one end of a gas chamber to said gas mixing chamber between said tapered nozzle and before said rotatable pressure sealing means and secureably attaching the other end of said gas chamber to a quick operating valve means;

O. secureably attaching two gas introduction means to said gas chamber, positioned so that one gas introduction means directs gas to said gas mixing chamber and one gas introduction means directs gas to said quick operating valve means thereby enabling gas to be introduced into and withdrawn from said gas mixing chamber;

P. providing a measuring means comprised of a geared track along which both said oppositely positioned moveable motors may move and wherein one of said moveable motors is always positioned in a fixed location when receiving said tubular extensions and wherein the second said moveable motor is moved to allow the insertion of the opposite end of said tubular extension into said rotatable cone so that the distance said second moveable motor has traveled on said track from the fixed location of said first said moveable motor can be readily measured;

Q. providing an inner directing tube of said radially finned directing means for directing relatively more of said coating means into the center of said tubular extension;

R. attaching a plurality of outer directing vanes of said radially finned directing means to the outer surface of said inner directing tube which spiral around the outside of said tube in a direction opposite from the rotation of said rotatable cones and said tubular extensions held by said rotatable cones so that relatively less of said coating material is forced to travel farther around the outside of said inner directing tube thereby slowing said coating material down and throwing said coating material outwardly from said inner directing tube;

S. wrapping around and attaching a pair of oppositely positioned vane retention and support rings to said outer directing vanes at each end of said vanes;

T. providing a combination of electrically operated quick operating gas valves and a plurality of gas regulation means whereby gas pressure of a predetermined amount will be released when said quick operating valves are electronically opened;

U. attaching two oppositely positioned gas manifolds for providing a constant supply of gas to said combination gas regulation means and said quick operating valves;

V. connecting said gas manifolds to said gas regulators and connectors said gas regulators to said quick acting valves and connecting said quick acting valves to said connections in the base of said fluid beds, to said oppositely positioned gas introduction means secureably attached to and projected into said gas chamber so that gas of a plurality of pressures and at various times may be introduced to said apparatus;

W. providing a programmable controller means which receives information concerning the length of said tubular extensions from said measuring means and which receives inforamtion from an operator concerning the inside diameter of said tubular extensions and which is connected to said gas regulators and said quick acting valves so that the appropriate amount of gas is released and the quick acting valves are opened the appropriate amount of time so that an appropriate amount of coating material is released first from one fluid bed and then the other;

X. actuating said programmable controller so that a measured amount of coating material is introduced into said pipe and deposited thereon;

Y. attaching a breather-muffler-filter means for filtering and muffling air withdrawn from said dual action apparatus;

Z. slidably attaching at their base two oppositely positioned idler means to a downstream track guidance means along which said idlers may move so that said idlers may be positioned beneath said tubular extension and provide support for said tubular extension while rotating; and AA. providing a pair of powered roller means located on said downstream track guidance means so that said tubular extension can be rotated during end preparation.

2. Automatic dual action self contained apparatus for uniformly coating the inside of tubular extensions comprising:

A. a pair of oppositely positioned rotatable cones with the wide end facing outwardly to receive one end of a tubular extension;

B. a means securedly connecting the narrow end of said rotatable cone to a rotating section of uniform circumference within which a radially finned directing means is secured;

C. a rotatable pressure sealing means for connecting the opposite end of said rotating section with a stationary transfer and mixing means from each of two oppositely positioned fluid beds;

D. two oppositely positioned belt and pulley systems engageably attached to the rotating sections of two moveable motors;

E. two pillow block bearings, one on either side of said belt and pulley systems, for supporting said rotating section while allowing said rotating section to turn freely;

F. a connection in the base of said fluid beds whereby gas, such as air, may be introduced into said fluid beds;

G. a gas receiving chamber in said fluid beds formed by the base and side walls of said fluid bed and a gas permeable separator, which prevents coating material contained in said fluid beds from invading said receiving chamber and which allows gas to pass through said permeable separator into said fluid beds containing said coating material;

H. an exit port located low on a side of said fluid beds so that an exit for said coating material is formed in said fluid bed just above permeable separator which is in line with and securedly attached to said stationary transfer and mixing means;

I. a secureably attached connection to said exit port;

J. a quick operating valve means located just after said exit port connection;

K. a tapered nozzle attached to the opposite end of said quick operating valve;

L. a coating maerial and gas mixing chamber secureably attached to said tapered nozzle near the base of said tapered nozzle so that said tapered nozzle extends into said mixing chamber and wherein said mixing chamber is connected to said rotatable support cone by means of said rotatable pressure sealing means;

M. two oppositely positioned gas introduction means secureably attached to and projected into said gas mixing chamber near the base of said gas mixing chamber where said gas mixing chamber attaches to said tapered nozzle wherein said gas introduction means are positioned so as to cause gas introduction into said gas mixing chamber to rotate and swirl within said mixing chamber and to create a reduced air pressure at said quick operating valve means;

N. a gas chamber with one end secureably attached to and opening into said gas mixing chamber between said tapered nozzle and before said rotatable pressure sealing means and wherein the other end of said gas chamber is securedly connected to a quick operating valve means;

O. two gas introduction means secureably attached to and projected into said gas chamber and positioned so that one gas introduction means directs gas to said gas mixing chamber and one gas introduction means directs gas to said quick operating valve means thereby enabling gas to be introduced into and withdrawn from said gas mixing chamber;

P. a measuring means comprised of a geared track along which both said oppositely positioned moveable motors may move and wherein one of said moveable motors is always positioned in a fixed location when receiving said tubular extensions and wherein the second said moveable motor is moved to allow the insertion of the opposite end of said tubular extension into said rotatable cone so that the distance said second moveable motor has traveled on said track from the fixed location of said first said moveable motor can be readily measured;

Q. an inner directing tube of said radially finned directing means for directing relatively more of said coating means into the center of said tubular extension;

R. a plurality of outer directing vanes of said radially finned directing means which are securedly attached to the outer surface of said inner directing tube and which spiral around the outside of said tube in a direction opposite from the rotation of said rotatable cones and said tubular extensions held by said rotatable cones so that relatively less of said coating material is forced to travel farther around the outside of said inner directing tube thereby slowing said coating material down and throwing said coating material outwardly from said inner directing tube;

S. a pair of oppositely positioned vane retention and support rings which wrap around and are attached to said outer directing vanes at each end of said vanes;

T. a combination of electrically operated quick operating gas valves and a plurality of gas regulation means whereby gas pressure of a predetermined amount will be released when said quick operating valves are electronically opened;

U. two oppositely positioned gas manifolds for providing a constant supply of gas to said combination gas regulation means and said quick operating valves;

V. connection of said gas manifolds to said gas regulators and connection of said gas regulators to said quick acting valves and connection of said quick acting valves to said connections in the base of said fluid beds, to said oppositely positioned gas introduction means secureably attached to and projected into said gas chamber so that gas of a plurality of pressures and at various times may be introduced to said apparatus;

W. a programmable controller means which receives information concerning the length of said tubular extensions from said measuring means and which receives information from an operator concerning the inside diameter of said tubular extensions and which is connected to said gas regulators and said quick acting valves so that the appropriate amount of gas is released and the quick acting valves are opened the appropriate amount of time so that an appropriate amount of coating material is released first from one fluid bed and then the other;

X. a breather-muffler-filter means for filtering and muffling air withdrawn from said dual action apparatus;

Y. two oppositely positioned idler means which are slidably attached at their base to a downstream track guidance means along which said idlers may move so that said idlers may be positioned beneath said tubular extension and provide support for said tubular extension while rotating; and Z. a pair of powered roller means located on said downstream track guidance means so that said tubular extension can be rotated during end preparation.

3. Automatic dual action self contained apparatus for uniformly coating the inside of tubular extensions comprising:

A. two oppositely positioned rotatable support cones for supporting and rotating a plurality of variously sized tubular extensions;

B. two oppositely positioned moveable motors attached to said rotatable cones so that said cones can be rotated;

C. two oppositely positioned fluid beds for containment of a coating material;

D. a stationary mixing and transfer means connecting said fluid beds to the rear of said rotatable cones;

E. a means whereby gas may be introduced to and withdrawn from said stationary mixing and transfer means;

F. a measuring means for measuring the length of said tubular extension supported between said cones;

G. a radially finned directing means located in said rotatable support cones that directs relatively more of said coating material past the beginning of said tubular extension into the center of a length of said tubular extension and that directs relatively less of said coating material to the beginning of said tubular extension; and H. a governing system whereby the operation of both sides of the apparatus are controlled and coordinated so that a measured amount of said coating material is introduced from first one end,coating said extension almost to the opposite end, and then from said opposite end, coating said extension almost to said first end, with no excess coating material introduced.

4. The automatic dual action apparatus of claim 3 wherein said oppositely positioned rotatable support cones comprise:

A. a cone shaped portion with the wide end facing outward to receive one end of said tubular extension;

B. a means securedly connecting the narrow end of said cone shaped portion with a rotating section of uniform circumference within which said radially finned directing means is secured; and C. a rotatable pressure sealing means for connecting the opposite end of said rotating section with said stationary transfer and mixing means from said fluid beds.

5. The automatic dual action apparatus of claim 4 wherein said oppositely positioned fluid beds comprise:

A. a connection in the base of said fluid beds whereby gas, such as air, may be introduced into said fluid beds;

B. a gas receiving chamber in said fluid beds formed by the base and side walls of said fluid bed and a gas permeable separator which prevents said coating material from invading said receiving chamber and which allows gas to pass through said separator into said fluid beds containing said coating material; and C. an exit port located low on a side of said fluid beds so that an exit for said coating material is formed in said fluid bed just above said permeable separator which is in line with and securedly attached to said stationary transfer and mixing means.

6. The automatic dual action apparatus of claim 5 wherein said stationary transfer and mixing means connecting said fluid beds to the rear of said rotatable cones comprises:

A. a secureably attached connection to said exit port;

B. a quick operating valve means located just after said exit port connection;

C. a tapered nozzle attached to the opposite end of said quick operating valve;

D. a coating material and gas mixing chamber secureably attached to said tapered nozzle near the base of said tapered nozzle so that said tapered nozzle extends into said gas mixing chamber and wherein said gas mixing chamber is connected to said rotatable support cone by means of said rotatable pressure sealing means; and E. two oppositely positioned gas introduction means secureably attached to and projected into said gas mixing chamber near the base of said gas mixing chamber where said gas mixing chamber attaches to said tapered nozzle wherein said gas introduction means are positioned so as to cause gas introduced into said gas mixing chamber to rotate and swirl within said gas mixing chamber and to create a reduced air pressure at said quick operating valve means.

7. The automatic dual action apparatus of claim 6 wherein said means whereby gas may be introduced to and withdrawn from said stationary transfer and mixing means comprises:

A. a gas chamber with one end secureably attached to and opening into said gas mixing chamber between said tapered nozzle and before said rotatable pressure sealing means and wherein the other end of said gas chamber is securedly connected to a quick operating valve means; and B. two gas introduction means secureably attached to and projected into said gas chamber and positioned so that one gas introduction means directs gas to said gas mixing chamber and one gas introduction means directs gas to said quick operating valve means thereby enabling gas to be introduced into and withdrawn from said gas mixing chamber.

8. The automatic dual action apparatus of claim 7 wherein said measuring means comprises a geared track along which both said oppositely positioned moveable motors may move and wherein one of said moveable motors is always positioned in a fixed location when receiving a tubular extension and wherein the second said moveable motor is moved to allow the insertion of the opposite end of said tubular extension into said rotatable cone so that the distance the second moveable motor has traveled on said track from the fixed location of the first said moveable motor can be readily measured.

9. The automatic dual action apparatus of claim 8 wherein said radially finned directing means comprises;

A. an inner directing tube for directing relatively more of said coating means into the center of said tubular extension;

B. a plurality of outer directing vanes which are securedly attached to the outer surface of said inner directing tube and which spiral around the outside of said inner directing tube in a direction opposite from the rotation of said rotatable cones and said tubular extensions held by said rotatable cones so that relatively less of said coating material is forced to travel farther around the outside of said inner directing tube thereby slowing said coating material down and throwing said coating material outwardly from said inner directing tube; and C. a pair of oppositely positioned vane retention and support rings which wrap around and are attached to said outer directing vanes at each end of said vanes.

10. The automatic dual action apparatus of claim 9 wherein said governing system comprises:

A. a combination of electrically operated quick operating gas valves and a plurality of gas regulation means whereby gas pressure of a predetermined amount will be released when said quick operating valves are electronically opened;

B. two oppositely positioned gas manifolds for providing a constant supply of gas to said combination gas regulation means and said quick operating valves;

C. connection of said gas manifolds to said gas regulators and connection of said gas regulators to said quick acting valves and connection of said quick acting valves to said connections in the base of said fluid beds, to said oppositely positioned gas introduction means secureably attached to and projected into said gas chamber so that gas of a plurality of pressures and at various times may be introduced to said apparatus; and D. a programmable controller means which receives information concerning the length of said tubular extensions from said measuring means and which receives information from an operator concerning the inside diameter of said tubular extensions and which is connected to said gas regulators and said quick acting valves so that the appropriate amount of gas is released and the quick acting valves are opened the apppropriate amount of time so that an appropriate amount of coating material is released first from one fluid bed and then the other.

11. The automatic dual action apparatus of claim 10 further comprising a tubular extension end preparation means wherein said end preparation means comprises:

A. two oppositely positioned idler means which are slidably attached at their base to a downstream track guidance means along which said idlers may move so that said idlers may be positioned beneath said tubular extension and provide support for said tubular extension while rotating; and B. a pair of powered roller means located on said downstream track guidance means, so that said tubular extension can be rotated during end preparation.

* * * * *